US006373446B2

(12) United States Patent
Apostolos

(10) Patent No.: US 6,373,446 B2
(45) Date of Patent: Apr. 16, 2002

(54) NARROW-BAND, SYMMETRIC, CROSSED, CIRCULARLY POLARIZED MEANDER LINE LOADED ANTENNA

(75) Inventor: John T. Apostolos, Merrimack, NH (US)

(73) Assignee: BAE Systems Information and Electronic Systems Integration INC, Nashua, NH (US)

( * ) Notice: Subject to any disclaimer, the term of this patent is extended or adjusted under 35 U.S.C. 154(b) by 0 days.

(21) Appl. No.: 09/871,036

(22) Filed: May 31, 2001

Related U.S. Application Data

(60) Provisional application No. 60/208,190, filed on May 31, 2000.

(51) Int. Cl.[7] ..... H01Q 21/26

(52) U.S. Cl. ..... 343/797; 343/700 MS; 343/795; 343/742

(58) Field of Search ..... 343/797, 795, 343/895, 700 MS, 741, 742, 866, 867, 743, 744

(56) References Cited

U.S. PATENT DOCUMENTS

| | | | | |
|---|---|---|---|---|
| 4,293,858 A | | 10/1981 | Hockham | 343/731 |
| 4,804,965 A | | 2/1989 | Roederer | 343/700 MS |
| 5,481,272 A | | 1/1996 | Yarsunas | 343/797 |
| 5,521,610 A | | 5/1996 | Roal | 343/797 |
| 5,563,616 A | | 10/1996 | Dempsey et al. | 343/753 |
| 5,592,182 A | | 1/1997 | Yan et al. | 343/742 |
| 5,784,032 A | | 7/1998 | Johnston et al. | 343/742 |
| 5,790,080 A | | 8/1998 | Apostolos | 343/744 |
| 5,796,372 A | * | 8/1998 | Elliot | 343/797 |
| 6,008,762 A | | 12/1999 | Nghiem | 343/700 MS |
| 6,028,563 A | * | 2/2000 | Higgins | 343/797 |
| 6,034,637 A | | 3/2000 | McCoy et al. | 343/700 MS |
| 6,150,993 A | | 11/2000 | Dobrovolny | 343/700 MS |

FOREIGN PATENT DOCUMENTS

| | | |
|---|---|---|
| WO | WO 01/13464 | 2/2001 |

* cited by examiner

*Primary Examiner*—Hoanganh Le
(74) *Attorney, Agent, or Firm*—Scott J. Asmus; Vernon C. Maine

(57) ABSTRACT

The present invention features an improved cross-element meander line loaded antenna. Two pairs of triangle-shaped elements are each connected at their vertices to form bow-tie elements. The bow-tie elements are arranged orthogonally adjacent a ground plane, reducing shadowing and cross-coupling, and providing an efficient and compact meander lines antenna. When fed in quadrature, the antenna radiates a circularly polarized RF field having an excellent axial ratio.

12 Claims, 6 Drawing Sheets

NARROW-BAND, SYMMETRIC, CROSSED, CIRCULARLY POLARIZED MEANDER LINE LOADED ANTENNA

CROSS REFERENCE TO RELATED APPLICATIONS

This application claims priority from U.S. Provisional Patent Application, Ser. No. 60/208,190, filed May 31, 2000.

FIELD OF THE INVENTION

The invention pertains to meander line loaded antennas and, more particularly, to a crossed element antenna utilizing bow-tie meander line loaded elements.

BACKGROUND OF THE INVENTION

In the past, efficient antennas have typically required structures with minimum dimensions on the order of a quarter wavelength of the radiating frequency. These dimensions allowed the antenna to be excited easily and to be operated at or near a resonance, limiting the energy dissipated in resistive losses and maximizing the transmitted energy. These antennas tended to be large in size at the resonant wavelength.

Further, as frequency decreased, the antenna dimensions increased in proportion. In order to address the shortcomings of traditional antenna design and functionality, researchers developed the meander line loaded antenna (MLA). One such MLA is disclosed in U.S. Pat. No. 5,790,080 for MEANDER LINE LOADED ANTENNA, which is hereby incorporated herein by reference. An example of an MLA, also known as a varied impedance transmission line antenna, is shown in FIG. 1. The antenna consists of two vertical conductors, 102, and a horizontal conductor, 104 wherein the horizontal conductors are separated from the vertical conductors by gaps, 106.

Meander lines, shown in FIG. 2, are connected between the vertical and horizontal conductors at the gaps. The meander lines are designed to adjust the electrical length of the antenna. In addition, the design of the meander slow wave structure permits lengths of the meander line to be switched in or out of the circuit quickly and with negligible loss, in order to change the effective electrical length of the antenna. This switching is possible because the active switching devices are always located in the high impedance sections of the meander line. This keeps the current through the switching devices low and results in very low dissipation losses in the switch, thereby maintaining high antenna efficiency.

The basic antenna of FIG. 1 can be operated in a loop mode that provides a "figure eight" coverage pattern. Horizontal polarization, loop mode, is obtained when the antenna is operated at a frequency such that the electrical length of the entire line, including the meander lines, is a multiple of full wavelength as shown in FIG. 3C. The antenna can also be operated in a vertically polarized, monopole mode, by adjusting the electrical length to an odd multiple of a half wavelength at the operating frequency, as shown in FIGS. 3B and 3D. The meander lines can be tuned using electrical or mechanical switches to change the mode of operation at a given frequency or to switch frequency using a given mode.

The meander line loaded antenna allows the physical antenna dimensions to be reduced significantly while maintaining an electrical length that is still a multiple of a quarter wavelength of the operating frequency. Antennas and radiating structures built using this design operate in the region where the limitation on their fundamental performance is governed by the Chu-Harrington relation:

$$\text{Efficiency}=FV_2Q$$

where:

Q=Quality Factor $V_2$=Volume of the structure in cubic wavelengths

F=Geometric Form Factor (F=64 for a cube or a sphere)

Meander line loaded antennas achieve the efficiency limit of the Chu-Harrington relation while allowing the antenna size to be much less than a wavelength at the frequency of operation. Height reductions of 10 to 1 can be achieved over quarter wave monopole antennas, while achieving comparable gain.

Discussion of the Related Art

The aforementioned U.S. Pat. No. 5,790,080 describes an antenna that includes one or more conductive elements for acting as radiating antenna elements, and a slow wave meander line adapted to couple electrical signals between the conductive elements. The meander line has an effective electrical length that affects the electrical length and operating characteristics of the antenna. The electrical length and operating mode of the antenna is readily controlled.

U.S. Pat. No. 6,034,637 for DOUBLE RESONANT WIDEBAND PATCH ANTENNA AND METHOD OF FORMING SAME, describes a double resonant wideband patch antenna that includes a planar resonator forming a substantially trapezoidal shape having a nonparallel edge for providing a wide bandwidth. A feed line extends parallel to the nonparallel edge for coupling, while a ground plane extends beneath the planar resonator for increasing radiation efficiency.

U.S. Pat. No. 6,008,762 for FOLDED QUARTER WAVE PATCH ANTENNA, describes a folded quarter-wave patch antenna which includes a conductor plate having first and second spaced apart arms. A ground plane is separated from the conductor plate by a dielectric substrate and is approximately parallel to the conductor plate. The ground plane is electrically connected to the first arm at one end. A signal unit is also electrically coupled to the first arm. The signal unit transmits and/or receives signals having a selected frequency band. The folded quarter-wave patch antenna can also act as a dual frequency band antenna. In dual frequency band operation, the signal unit provides the antenna with a first signal of a first frequency band and a second signal of a second frequency band.

Existing crossed element meander line antennas have some degree of shadowing and cross-coupling, especially antennas that cross-over another radiating surface. What is needed is an efficient antenna design that addresses the problems and limitations addressed herein. The improved antenna should have a symmetric radiation pattern and be able to operate in circular polarization.

SUMMARY OF THE INVENTION

In accordance with the present invention there is provided a crossed, circularly polarized, meander line loaded antenna (MLA), which utilizes pairs of bow-tie MLA elements to reduce pattern distortion caused by crossed MLA elements in prior art antennas.

It is, therefore, an object of the invention to provide a crossed MLA having a symmetric radiation pattern.

It is another object of the invention to provide a crossed MLA that can operate in a circular polarization mode.

It is an additional object of the invention to provide a crossed MLA having an improved axial ratio performance.

An object of the invention is a crossed-element, meander line loaded antenna comprising a ground plane, a dual bow-tie configuration with four triangular sections. Each of the sections has a side member substantially perpendicular from the ground plane and a triangle-shaped top member with a based end and a vertex end. The top member is disposed substantially parallel to the ground plane with the base end abutting the side member, being separated by a side gap. Each vertex end is arranged in close proximity to one another separated by a vertex gap, and there is a first connector operatively connecting a first pair of the triangular sections each at the vertex end. And, there is a second connector operatively connecting a second pair of the triangular sections each at the vertex end, wherein the first and second pair are orthogonal to each other.

A further object is a crossed-element, meander line loaded antenna, further comprising two or more capacitive flaps positioned at the side gaps. And, the crossed-element, meander line loaded antenna further comprising two or more meander line elements positioned at the side gaps.

An additional object is the crossed-element, meander line loaded antenna, wherein the top member is secured to a dielectric material. Furthermore, the crossed-element, meander line loaded antenna, wherein the side member is secured to a dielectric material.

Another object is for the crossed-element, meander line loaded antenna wherein the first and second connector are meander lines elements.

An object of the invention includes a crossed-element, circularly polarized meander line loaded antenna, comprising a ground plane and a dual bow-tie configuration with four triangular sections. Each section having a having a side member substantially perpendicular from the ground plane and a triangle-shaped top member with a base end and a vertex end. The top member is disposed substantially parallel to the ground plane with the base end abutting the side member, being separated by a side gap. Each vertex end is arranged in close proximity to one another separated by a vertex gap. There is a first connector operatively connecting an opposing first pair of the triangular sections each at the vertex end, and a second connector operatively connecting an opposing second pair of the triangular sections each at the vertex end. And, there is a first signal feed connecting to the first pair and a second signal feed connecting to the second pair, wherein the second signal feed is 90 degrees out-of-phase.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

This present invention provides a crossed-element MLA structure that provides for circular polarization with good axial performance as well as good isolation between elements.

Figure 1:
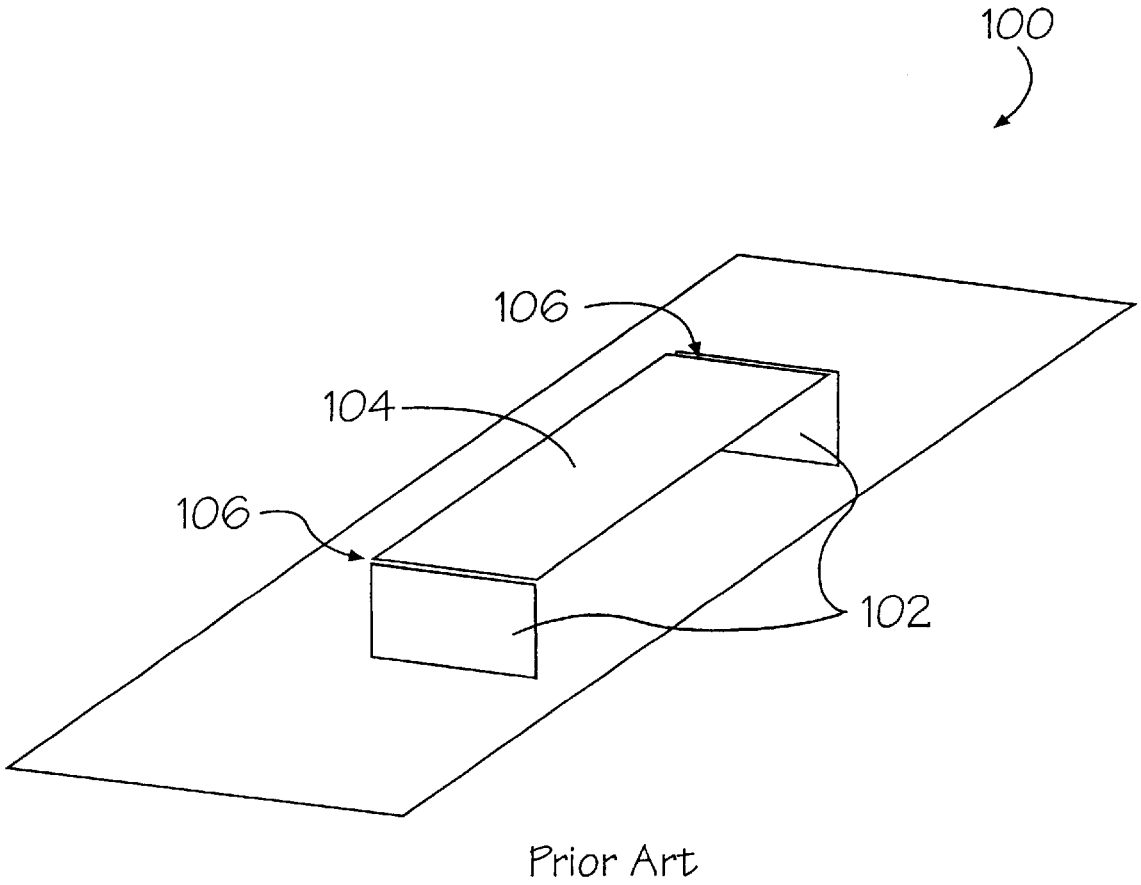
FIG. 1 is a schematic, perspective view of a meander line loaded antenna of the prior art.
Figure 2:
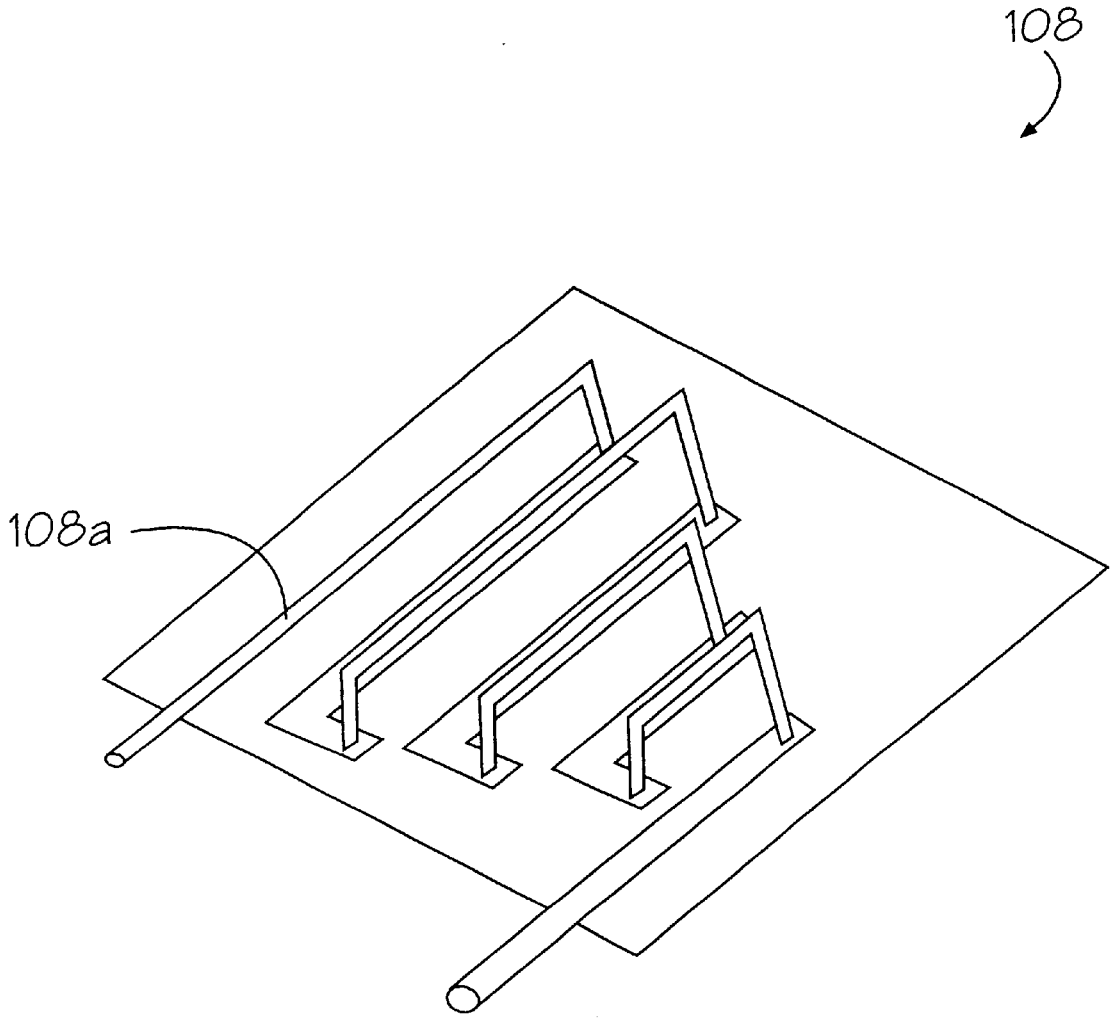
FIG. 2 is a schematic, perspective view of a meander line used as an element coupler in the meander line loop antenna of FIG. 1.
Figure 3:
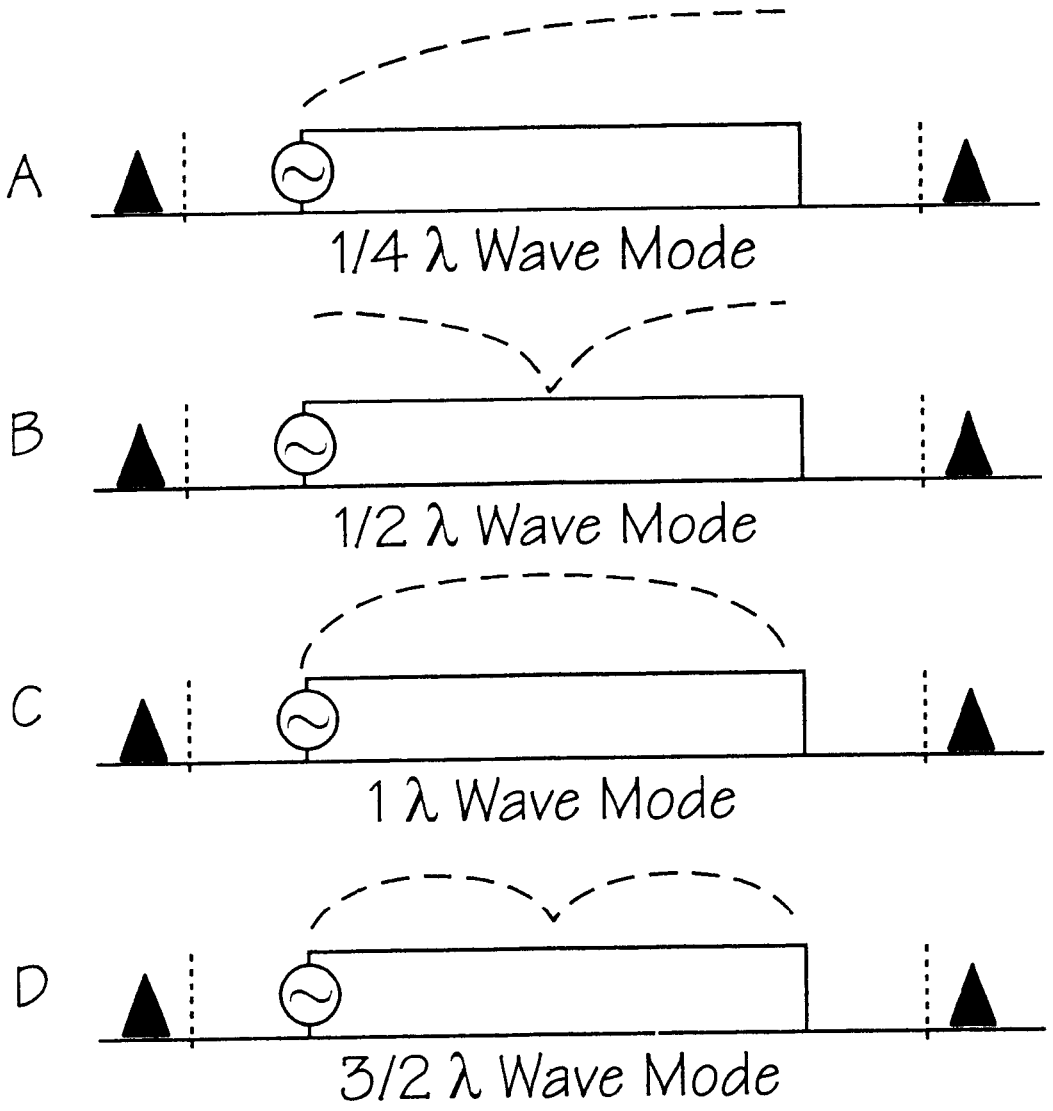
FIG. 3, consisting of a series of diagrams 3A through 3D, depicts four operating modes of the antenna.

FIG. 1 illustrates the prior art meander line loaded structure 100 described in more detail is U.S. Pat. No. 5,790,080. A pair of opposing side units 102 are connected to a ground plane 105 and extend substantially orthogonal from the ground plane 105. A horizontal top cover 104 extends between the side pieces 102, but does not come in direct contact with the side units 102. Instead, there are gaps 106 separating the side pieces 102 from the top cover 104. A meander line loaded element 108, such as the one depicted in FIG. 2 is placed on the inner comers of the structure 100 such that the meander line 108 resides near the gap on either the horizontal cover 104 or the side pieces 102.

The meander line loaded structure 108 provides a switching means to change the electrical length of the line and thereby effect the properties of the structure 100. As explained in more detail in the prior art, the switching enables the structure to operate in loop mode or monopole mode by altering the electrical length and hence the wavelengths as shown in FIGS. 3A–D.

Figure 4:
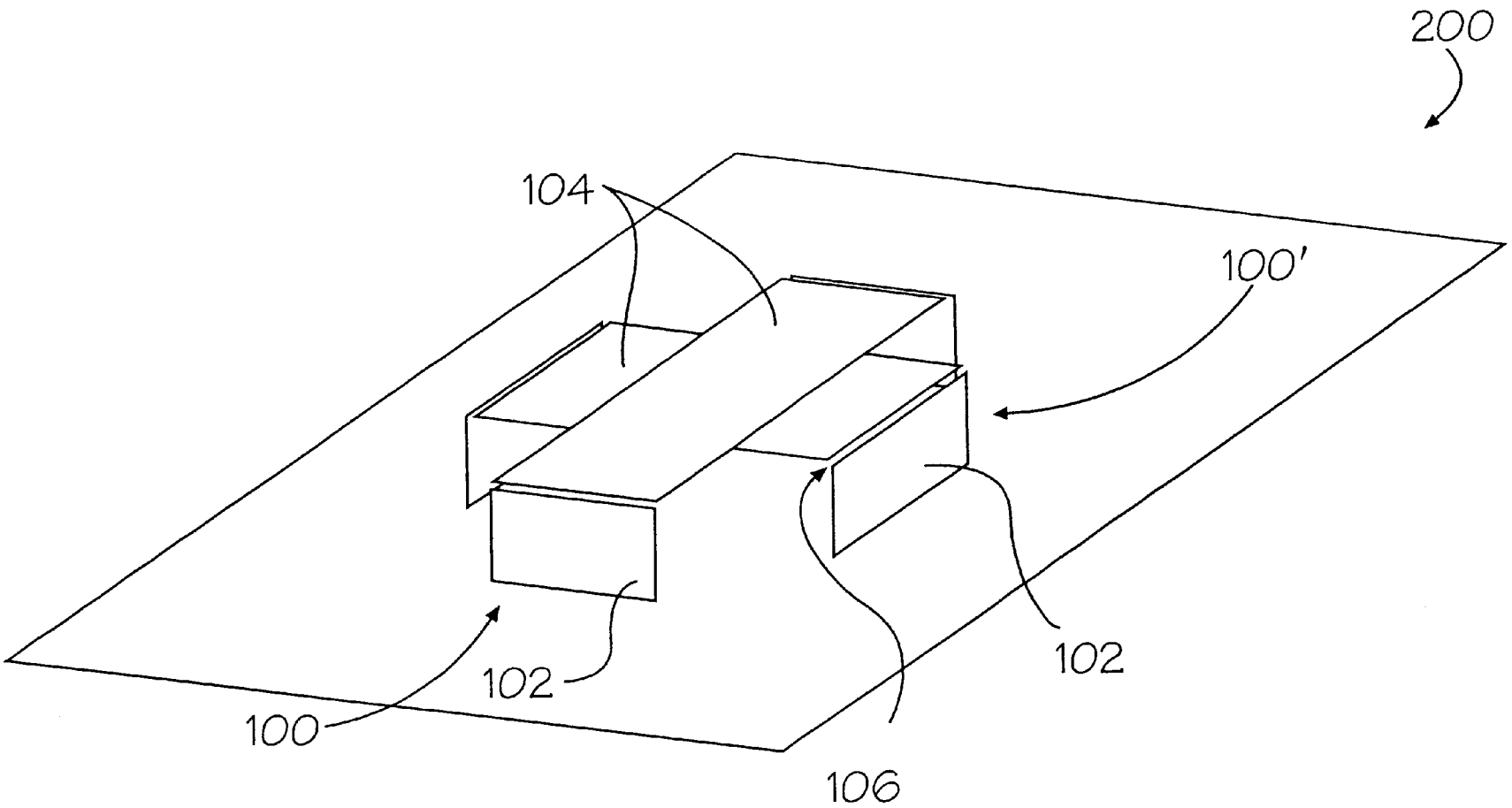
FIG. 4 is a schematic, perspective view of the dual band, crossed MLA antenna of the prior art.

One of the features of the present invention is the use of pairs of triangle-shaped MLA elements arranged in a bow-tie configuration. Referring first to FIG. 4, there is shown a schematic, perspective view of a conventional MLA crossed-element antenna, generally at reference number 100. Each MLA element 102, 104 has a traditional loop construction consisting of two vertical radiating surfaces 106 separated from a horizontal surface 108 by gaps 110.

The plane containing the electrical (E) and magnetic (H) fields radiating from the antenna is called the plane of polarization. This plane is orthogonal to the direction of propagation. Typically, the tip of the electric field vector moves along an elliptical path in the plane of polarization. Consequently, the polarization of the wave is at least partially defined by the shape and orientation of this ellipse. The shape of the ellipse is specified by its axial ratio (i.e., the ratio of its major axis to its minor axis). When applied as a qualitative measure to the performance of an antenna, generally a small axial ratio is preferable.

Figure 5:
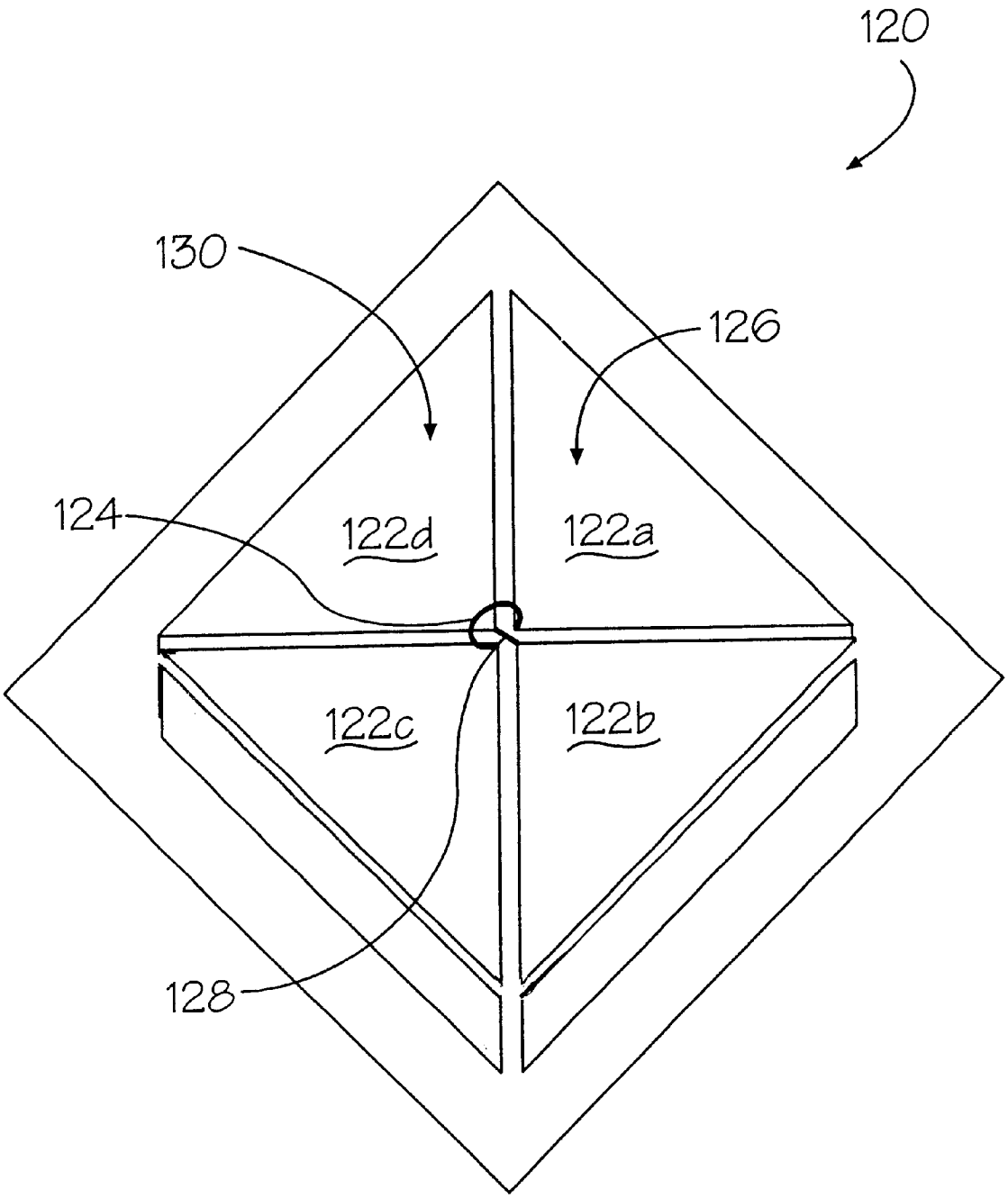
FIG. 5 is a schematic, perspective view of the crossed element, bow-tie shaped, circularly polarized antenna of the present invention.

When properly fed, the conventional MLA configuration of FIG. 5 is capable of producing a circularly polarized signal. However, because a large portion of lower MLA element 102 is completely shadowed by upper MLA element 104, the axial ratio of the antenna 100 is relatively poor. In addition to the poor axial ratio response, antenna 100 suffers from interaction between MLA elements 102 and 104.

Referring now to FIG. 5, there is shown a schematic, perspective of an improved, crossed-element MLA, generally at reference number 120. The pair of MLA loop elements 102, 104 (FIG. 4) has been replaced by pairs of triangular elements 122*a*, 122*b*, 122*c*, and 122*d*. Elements 122*a* and 122*c* are electrically coupled at point 124, and their interior vertices form a first bow-tie element 126. Likewise, elements 122*b* and 122*d* are coupled at point 128 to form a second bow-tie element 130, orthogonal to first bow-tie element 126. Bow-tie elements 126, 130 are each meander line loaded elements. By eliminating the shadowing problems of the prior art crossed antenna 100 (FIG. 4), cross-coupling between the bow-tie elements 126, 130 is reduced. In addition, the axial response from the inventive arrangement is improved. To achieve circular polarization, the bow-tie elements 126, 130 are fed in quadrature (i.e., the voltage feeds are 90° out-of-phase) as is well known to those skilled in the antenna design arts.

The triangular elements 122*a–d* may have flush vertices rather than 'arrow head' pointed ends for manufacturing efficiency. In one embodiment the triangular elements are secured to a dielectric plate to orient the elements and keep them securely in place wherein they are fastened to the dielectric.

Figure 6:
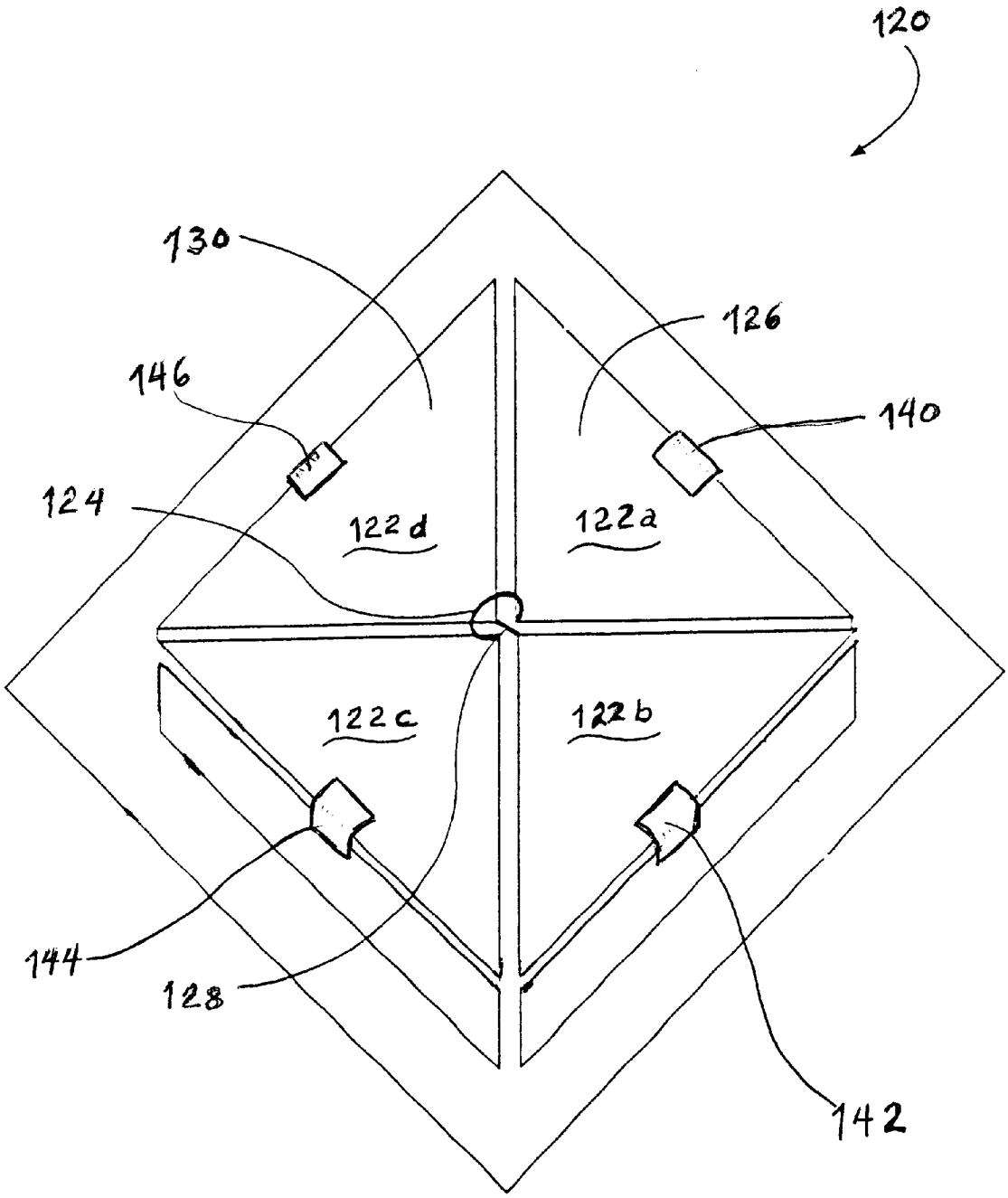
FIG. 6 is a schematic, perspective view of the crossed element, bow-tie shaped, circularly polarized antenna including capacitive flaps.

Another embodiment is shown in FIG. 6, wherein the bow-tie arrangement incorporates capacitive flaps. The capacitive flaps 140, 142, 144, 146 can be mounted upon all four triangular 122*a*, 122*b*, 122*c*, 122*d* to allow for adequate tuning. A further description of the capacitive flaps is described in a pending patent application entitled NARROW-BAND, CROSSED-ELEMENT, OFFSET-TUNED DUAL BAND, DUAL MODE MEANDER LINE LOADED ANTENNA by the same inventor and filed May 31, 2001. In summary, the capacitive flaps allow capacitive tuning of the structure. An application for such tuning as described in the cited patent application relates to operating the antenna as a dual band dual mode device wherein a higher frequency loop mode signal has a naturally occurring lower frequency monopole resonant frequency. The capacitive flaps enable the user to alter the frequency of the monopole resonant frequency to a more useful frequency signal or bandwidth to enable dual band operation. And, the flaps allow offset tuning of one of the bow-tie structures to produce a pair of monopole antennas with an in-phase frequency that is vertically polarized. This monopole operation has no effect on the loop mode operation and allows the dual band operation.

As to the dimensions of the bow-tie meander line antennas, the Chu-Harrignton provides an efficiency formula that is inversely proportional to Since other modifications and changes varied to fit particular operating conditions and environments or designs will be apparent to those skilled in the art, the invention is not considered limited to the examples chosen for purposes of disclosure, and covers changes and modifications which do not constitute departures from the true scope of this invention.

Having thus described the invention, what is desired to be protected by letters patents is presented in the subsequently appended claims.

What is claimed is:

1. A crossed-element, meander line loaded antenna comprising:

a) a ground plane;

b) a dual bow-tie configuration with four triangular sections each said section having a side member substantially perpendicular from said ground plane and a triangle-shaped top member with a base end and a vertex end, said top member disposed substantially parallel to said ground plane with said base end abutting said side member being separated by a side gap, wherein each said vertex end is arranged in close proximity to one another separated by a vertex gap;

c) a first connector operatively connecting a first pair of said triangular sections each at said vertex end;

d) a second connector operatively connecting a second pair of said triangular sections each at said vertex end, wherein said first and second pair are orthogonal to each other.

2. The crossed-element, meander line loaded antenna according to claim 1, further comprising two or more capacitive flaps positioned at said side gaps.

3. The crossed-element, meander line loaded antenna according to claim 1, further comprising two or more meander line elements positioned at said side gaps.

4. The crossed-element, meander line loaded antenna according to claim 1, wherein said top member is secured to a dielectric material.

5. The crossed-element, meander line loaded antenna according to claim 1, wherein each said side member is secured to a dielectric material.

6. The crossed-element, meander line loaded antenna according to claim 1, wherein said first and second connector are meander lines elements.

7. A crossed-element, circularly polarized meander line loaded antenna, comprising:

a) a ground plane;

b) a dual bow-tie configuration with four triangular sections each said section having a having a side member substantially perpendicular from said ground plane and a triangle-shaped top member with a base end and a vertex end, said top member disposed substantially parallel to said ground plane with said base end abutting said side member being separated by a side gap, wherein each said vertex end is arranged in close proximity to one another separated by a vertex gap;

c) a first connector operatively connecting an opposing first pair of said triangular sections each at said vertex end; and d) a second connector operatively connecting an opposing second pair of said triangular sections each at said vertex end;

e) a first signal feed connecting to said first pair;

f) a second signal feed connecting to said second pair, wherein said second signal feed is approximately 90 degrees out-of-phase to said first signal feed.

8. The crossed-element, meander line loaded antenna according to claim 7, further comprising two or more capacitive flaps positioned at said side gaps.

9. The crossed-element, meander line loaded antenna according to claim 7, further comprising two or more meander line elements positioned at said side gaps.

10. The crossed-element, meander line loaded antenna according to claim 7, wherein said top member is secured to a dielectric material.

11. The crossed-element, meander line loaded antenna according to claim 7, wherein said side member is secured to a dielectric material.

12. The crossed-element, meander line loaded antenna according to claim 7, wherein said first and second connector are meander lines elements.

* * * * *